US007995007B2

(12) United States Patent
Itokawa et al.

(10) Patent No.: US 7,995,007 B2
(45) Date of Patent: Aug. 9, 2011

(54) METHOD FOR DRIVING PLASMA DISPLAY PANEL

(75) Inventors: Naoki Itokawa, Kawasaki (JP); Yoshiho Seo, Kawasaki (JP); Yasunobu Hashimoto, Kawasaki (JP); Tetsuya Sakamoto, Kawasaki (JP); Tomokatsu Kishi, Kawasaki (JP)

(73) Assignees: Hatachi Plasma Patent Licensing Co., Ltd., Tokyo (JP); Hitachi Plasma Display Limited, Miyazaki (JP)

( * ) Notice: Subject to any disclaimer, the term of this patent is extended or adjusted under 35 U.S.C. 154(b) by 785 days.

(21) Appl. No.: 12/081,028

(22) Filed: Apr. 9, 2008

(65) Prior Publication Data

US 2008/0198100 A1 Aug. 21, 2008

Related U.S. Application Data

(63) Continuation of application No. 10/807,535, filed on Mar. 24, 2004, now Pat. No. 7,570,231.

(30) Foreign Application Priority Data

Mar. 28, 2003 (JP) ..... 2003-092215
Feb. 24, 2004 (JP) ..... 2004-048529

(51) Int. Cl.
*G09G 3/28* (2006.01)

(52) U.S. Cl. ..... 345/68; 315/169.4; 313/582

(58) Field of Classification Search ..... 345/41–42, 345/60, 63, 68, 204, 214; 315/169.1–169.4; 313/582

See application file for complete search history.

(56) References Cited

U.S. PATENT DOCUMENTS

| | | | | |
|---|---|---|---|---|
| 4,349,819 | A | 9/1982 | Terakawa | 345/63 |
| 5,642,018 | A | 6/1997 | Marcotte | |
| 6,011,355 | A | 1/2000 | Nagai | |
| 6,100,859 | A * | 8/2000 | Kuriyama et al. | 345/60 |
| 6,175,192 | B1 | 1/2001 | Moon | |
| 6,653,993 | B1 | 11/2003 | Nagao et al. | |
| 6,784,857 | B1 | 8/2004 | Nakamura | |
| 6,784,858 | B2 | 8/2004 | Awamoto | 345/60 |
| 6,853,358 | B2 | 2/2005 | Kunii et al. | |
| 6,900,781 | B1 | 5/2005 | Mori et al. | |
| 6,933,911 | B2 | 8/2005 | Suzuki | 345/60 |

(Continued)

FOREIGN PATENT DOCUMENTS

EP 1 065 645 1/2001

(Continued)

OTHER PUBLICATIONS

U.S. Appl. No. 10/807,535, filed Mar. 24, 2003, Naoki Itokawa, et al.

(Continued)

*Primary Examiner* — Abbas Abdulselam
(74) *Attorney, Agent, or Firm* — Staas & Halsey LLP

(57) ABSTRACT

A method for driving a plasma display panel is provided in which wasteful power consumption is reduced and light emission efficiency is improved when the number of cells to be lighted is relatively small. The method includes classifying a display ratio into plural group ranges, selecting a suitable display pulse waveform for each group range, detecting the display ratio of an object to be displayed in a real display, and plural types of display pulses having different waveforms are used differently in accordance with the result of the detection. The display ratio means a ratio of the number of cells to be lighted to the number of cells of the screen.

7 Claims, 6 Drawing Sheets

U.S. PATENT DOCUMENTS

| | | | | |
|---|---|---|---|---|
| 7,050,022 | B2 | 5/2006 | Kigo et al. | |
| 2001/0005188 | A1 | 6/2001 | Watanabe | |
| 2001/0033263 | A1 | 10/2001 | Yamada et al. | |
| 2002/0008678 | A1 | 1/2002 | Rutherford | |
| 2002/0054001 | A1 | 5/2002 | Awamoto | 345/60 |
| 2003/0122743 | A1 | 7/2003 | Suzuki | |
| 2003/0169214 | A1 | 9/2003 | Kigo et al. | |
| 2003/0173903 | A1 | 9/2003 | Takeuchi et al. | |
| 2003/0179162 | A1 | 9/2003 | Ooe et al. | |
| 2004/0001035 | A1 | 1/2004 | Awamoto et al. | |
| 2004/0021622 | A1 | 2/2004 | Nagao et al. | 345/60 |
| 2005/0073476 | A1 | 4/2005 | Takagi et al. | |
| 2005/0162348 | A1 | 7/2005 | Ogawa et al. | |

FOREIGN PATENT DOCUMENTS

| | | |
|---|---|---|
| EP | 1 376 524 | 1/2004 |
| JP | 52-150941 | 12/1977 |
| JP | 6-4039 | 1/1994 |
| JP | 7-134565 | 5/1995 |
| JP | 11-65523 | 3/1998 |
| JP | 10-177363 | 6/1998 |
| JP | 10-333635 | 12/1998 |
| JP | 11-85099 | 3/1999 |
| JP | 2000-206928 | 7/2000 |
| JP | 2001-5423 | 1/2001 |
| JP | 2001-13913 | 1/2001 |
| JP | 2001-34227 | 2/2001 |
| JP | 2001-75528 | 3/2001 |
| JP | 2001-228820 | 8/2001 |
| JP | 2002-189443 | 7/2002 |
| JP | 2003-280571 | 10/2003 |
| JP | 2003-337568 | 11/2003 |
| JP | 2004-37538 | 2/2004 |
| JP | 2004-93888 | 3/2004 |
| JP | 2004-144931 | 5/2004 |
| JP | 2004-151348 | 5/2004 |
| JP | 2004-233855 | 8/2004 |
| JP | 2005-114753 | 4/2005 |
| KR | 2002-0059711 | 7/2002 |
| KR | 2002-0061913 | 7/2002 |
| KR | 2004-0002309 | 1/2004 |
| KR | 10-0574124 | 4/2006 |
| WO | WO 01/37250 A1 | 5/2001 |
| WO | WO 02/23518 A1 | 3/2002 |

OTHER PUBLICATIONS

European Search Report, dated Jul. 19, 2006, for related European Patent Application No. EP 04 25 1815.9-2205.

Communication mailed from the Japanese Patent Office on Jul. 21, 2009 in the related Japanese patent application No. 2004-048529.

Office communication mailed from the United States Patent and Trademark Office on Jul. 9, 2007 in the related U.S. Appl. No. 10/807,535.

Office communication mailed from the United States Patent and Trademark Office on Jan. 9, 2008 in the related U.S. Appl. No. 10/807,535.

Office communication mailed from the United States Patent and Trademark Office on May 14, 2008 in the related U.S. Appl. No. 10/807,535.

Office communication mailed from the United States Patent and Trademark Office on Nov. 14, 2008 in the related U.S. Appl. No. 10/807,535.

Communication issued by the Korean Patent Office in the related Korean patent application KR10-2004-0020462.

* cited by examiner

METHOD FOR DRIVING PLASMA DISPLAY PANEL

CROSS-REFERENCE TO RELATED APPLICATIONS

This application is a continuation of U.S. application Ser. No. 10/807,535, filed Mar. 24, 2004, now U.S. Pat. No. 7,570,231 and now allowed, which further claims the benefit of priority of Japanese Patent Application No. 2003-092215 filed Mar. 28, 2003, the contents of which are incorporated herein by reference.

BACKGROUND OF THE INVENTION

1. Field of the Invention

The present invention relates to a method for driving a plasma display panel (PDP).

There is a task of improving light emission efficiency for a display using a plasma display panel. It is desired to realize a brighter display with less power consumption. The light emission efficiency depends not only on a cell structure but also on a driving method.

2. Description of the Related Art

A driving method of an AC type plasma display panel utilizes wall voltage for a display. The wall voltage is generated when a dielectric layer that covers a pair of display electrodes is charged. Wall voltages of cells in which display discharge is to be generated among cells within a screen are set higher than wall voltages of other cells, and then an appropriate display pulse (also called a sustain pulse) is applied to every cell at one time. When the display pulse is applied, a drive voltage is added to the wall voltage. The display discharge is generated only in cells that have sum voltage of the drive voltage and the wall voltage exceeding a discharge start voltage. Light emission by the display discharge is called "lighting". Utilizing the wall voltage, only cells to be lighted can be lighted selectively.

The display pulse is applied plural times that is set to the number corresponding to brightness of the display so that a polarity of the drive voltage is reversed every time. An application period is approximately a few microseconds, so that the light emission is observed to be continuous. When display discharge is generated by the first application, wall charge on the dielectric layer is erased once, and regeneration of wall charge is started promptly. A polarity of the regenerated wall charge is opposite to the previous one. When the wall charge is reformed, a cell voltage between display electrodes drops so that the display discharge ends. The end of discharge means that discharge current flowing in the display electrode becomes substantially 0 (zero). The application of the drive voltage to the cell continues until the trailing edge of the display pulse after the display discharge ends. Therefore, the space charge is attracted to the dielectric layer in an electrostatic manner, and reformation of the wall charge is progressed. Each of the display pulses has a role of generating display discharge and reforming an appropriate quantity of wall charge.

In general, the display pulse has a rectangular waveform. In other words, a usual driving circuit is constituted to output a rectangular waveform. In a design of the driving circuit, amplitude of the display pulse, i.e., a sustaining voltage Vs having a rectangular waveform is determined to be a value within a permissible range that is determined on the basis of discharge characteristics of the plasma display panel. If the sustaining voltage Vs is set to a value higher than the maximum value $Vs_{max}$ that is nearly the discharge start voltage Vf, discharge may be generated also in a cell that is not to be lighted. In addition, if the sustaining voltage Vs is set to a value lower than the minimum sustaining voltage $Vs_{min}$ that is a lower limit value, the wall charge cannot be reformed sufficiently, resulting in unstable repeat of lighting.

A typical driving method in which a rectangular display pulse is applied cannot improve both luminance and light emission efficiency. When the amplitude of the display pulse is increased within a permissible range, intensity of the display discharge can be enlarged so that the light emission luminance can be improved. However, the attempt to increase the light emission luminance may cause increase of power consumption and drop of the light emission efficiency. A solution of this problem is described in Japanese unexamined patent publication No. 10-333635, in which a display pulse is applied that has a step-like waveform with a leading edge having locally large amplitude.

In addition, Japanese unexamined patent publication No. 52-150941 discloses another waveform of the display pulse that has a step-like waveform in which the amplitude increases between a leading edge and a trailing edge. This step-like waveform has an advantage that can generate discharge at a low voltage and form an adequate quantity of wall charge.

There is a problem in the conventional driving method, which is that electric power is consumed wastefully when the number of cells to be lighted is small regardless that the display pulse waveform is either the rectangular waveform or the step-like waveform. When the number of cells to be lighted is small, discharge current in the entire screen and the voltage drop in the power source are smaller than in the case where the number of cells to be lighted is large. Namely, the minimum sustaining voltage $Vs_{min}$ is higher as the number of cells to be lighted is larger. In contrast, the appropriate sustaining voltage Vs is relatively low when the number of cells to be lighted is small. However, when designing a display pulse, it is important to determine the amplitude of the display pulse in consideration of a voltage drop when the number of cells to be lighted is the maximum, i.e., all cells are lighted, so that a correct display is realized regardless of the number of cells to be lighted. As explained above, if the amplitude of the display pulse is determined on the basis of the drive when the number of cells to be lighted is large, an excessive voltage may be applied to cells to form excessive wall charge when the number of cells to be lighted is small. As a result, a loss of electric power will be increased, and the light emission efficiency will drop.

SUMMARY OF THE INVENTION

An object of the present invention is to reduce electric power that is consumed wastefully. Another object is to increase light emission efficiency when the number of cells to be lighted is relatively small.

According to an aspect of the present invention, values of a display ratio are classified into group ranges in advance so that a suitable display pulse waveform is selected for each of the group ranges. In a real display, the display ratio of an object to be displayed is detected, and plural types of display pulses having different waveforms are used differently in accordance with the result of the detection. The display ratio means a ratio of the number of cells to be lighted to the number of cells of the screen.

Typical examples of the display pulse waveforms include a rectangular waveform, a step-like waveform having small amplitude between the leading edge and the trailing edge (that is referred to as a first step-like waveform), and a step-like waveform having large amplitude between the leading edge and the trailing edge (that is referred to as a second step-like waveform). The rectangular waveform is a simple waveform having constant amplitude, so it is advantageous for reducing an influence of variation of characteristics between cells and of fluctuation of characteristics due to variation of temperature. The first step-like waveform is advantageous for improving the light emission efficiency and is suitable when the display ratio is relatively small. The second step-like waveform is advantageous for avoiding insufficient formation of the wall charge due to a voltage drop and is suitable when the display ratio is relatively large. Combinations of waveforms in the case where there are two choices includes a set of the rectangular waveform and the second step-like waveform, a set of the first step-like waveform and the second step-like waveform, and a set of the first step-like waveform and the rectangular waveform.

When selecting the amplitude of the rectangular waveform and selecting the amplitude of each step of the step-like waveform, a power source can be used commonly by equalizing the value. For example, both the first step-like waveform and the second step-like waveform can be generated by controlling the connection timing of the display electrode with two power sources having different output voltages. The rectangular waveform can be generated by using one of the two power sources.

The group ranges can be overlapped with each other in the classification of the display ratio if the frame is divided into plural subframes for the display. Namely, plural waveforms may be used for a certain range. It is determined which waveform is used for a display of each subframe in accordance with a relationship of display ratio between subframes so that luminance of one frame becomes the highest value.

DETAILED DESCRIPTION OF THE PREFERRED EMBODIMENTS

Hereinafter, the present invention will be explained more in detail with reference to embodiments and drawings.

First Embodiment

Figure 1:
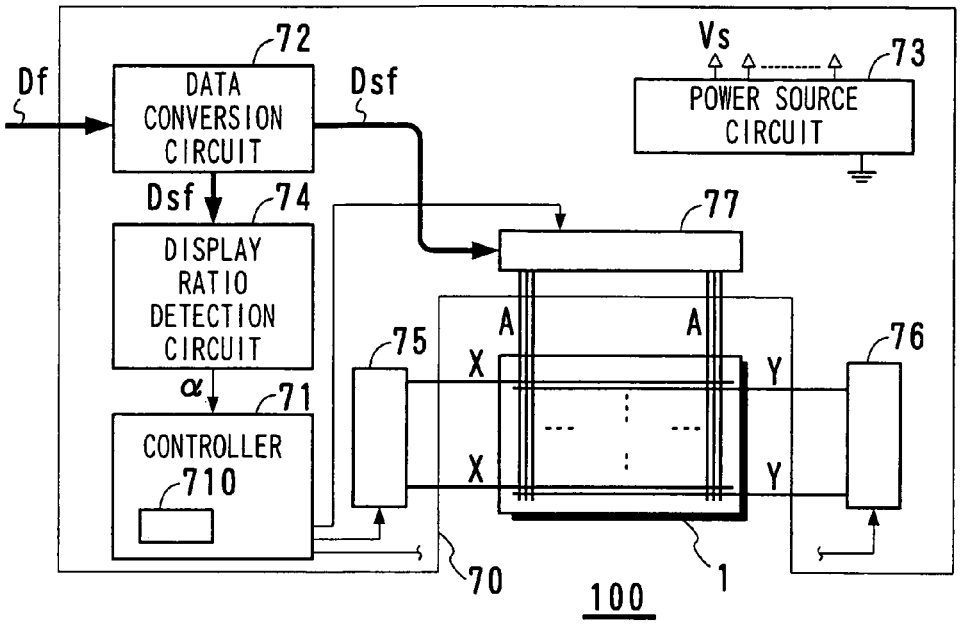
FIG. 1 shows a structure of a display device according to the present invention.

FIG. 1 shows a structure of a display device according to the present invention. A display device 100 includes a surface discharge AC type plasma display panel (PDP) 1 having a color display screen and a drive unit 70 for controlling light emission of cells. The display device 100 is used as a wall-hung television set, a monitor of a computer system or other equipment.

The plasma display panel 1 has electrode pairs for generating display discharge. Each of the electrode pairs includes a display electrode X and a display electrode Y arranged in parallel, and address electrodes A are arranged so as to cross the display electrodes X and Y. The display electrodes X and Y extend in the row direction (the horizontal direction) of the screen, while the address electrodes extend in the column direction (the vertical direction).

The drive unit 70 includes a controller 71, a data conversion circuit 72, a power source circuit 73, a display ratio detection circuit 74, an X-driver 75, a Y-driver 76, and an A-driver 77. The drive unit 70 is supplied with frame data Df from a TV tuner, a computer or other external equipment. The frame data Df indicate luminance levels of red, green and blue colors and are supplied together with various synchronizing signals. The frame data Df are stored temporarily in a frame memory that is included in the data conversion circuit 72. The data conversion circuit 72 converts the frame data Df into subframe data Dsf that are used for a gradation display and sends the subframe data Dsf to the A-driver 77. The subframe data Dsf is a set of display data, and each bit of the data corresponds to one cell. A value of each bit indicates whether or not a cell of the corresponding subframe is to be lighted, more specifically, whether or not address discharge is required for the cell. The A-driver 77 applies an address pulse to an address electrode A that is connected to the cell in which the address discharge is to be generated in accordance with the subframe data Dsf. To apply a pulse to an electrode means to bias the electrode to a predetermined potential temporarily. The controller 71 controls the pulse application and the transmission of the subframe data Dsf. The power source circuit 73 supplies electric power that is necessary for driving the plasma display panel 1 to each of the drivers.

When supplying power from the power source circuit 73 to the plasma display panel 1, a loss due to a resistance of a conductive path is inevitable. If a large value of current flows is concentrated in a short period, a large voltage drop is generated. A voltage that is actually applied to a cell of the plasma display panel 1 when a large value of current flows is relatively low compared with the case where the current value is small. To compensate the voltage drop by improving a capacity of the power source circuit 73 is not practical because it may raise a cost of the display device 100 substantially.

The display ratio detection circuit 74 detects a "display ratio $\alpha$" of each subframe by counting bits of the subframe data Dsf that indicate cells to be lighted. The display ratio $\alpha$ is a ratio of the number k of cells to be lighted to the total number K of cells in the subframe (for example, the display ratio $\alpha$ (percent)=k/K×100). The display ratio detection circuit 74 informs the controller 71 of the detected display ratio $\alpha$. The controller 71 selects a display pulse waveform in accordance with a display ratio $\alpha$ and increases or decreases the number of application times of the display pulse. The selection of the waveform is performed by looking up the relationship between the display ratio and the waveform that is stored in an internal memory 710 in advance.

Figure 2:
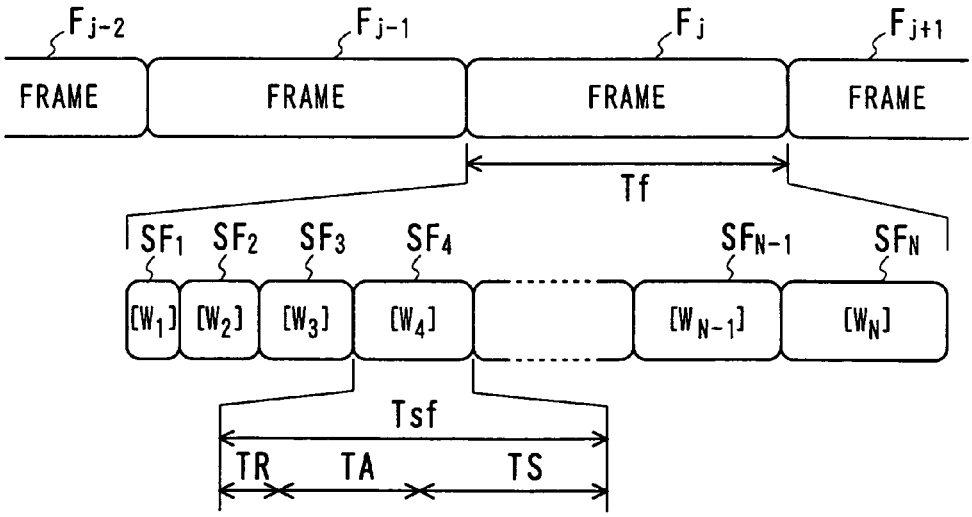
FIG. 2 is a conceptual diagram of frame division.

The driving sequence for the plasma display panel 1 in the display device 100 is as follows. In order to reproduce colors by binary lighting control in a display of the plasma display panel 1, a time series of frames $F_{j-2}$, $F_{j-1}$, $F_j$ and $F_{j+1}$ (hereinafter the suffixes indicating input orders will be omitted)

that corresponds the input image are divided into a predetermined number N of subframes $SF_1, SF_2, SF_3, SF_4, \ldots, SF_{N-1}$ and $SF_N$ (hereinafter the suffixes indicating display orders will be omitted) as shown in FIG. 2. Namely, each of the frames F is replaced with a set of N subframes SF. Luminance weights $W_1, W_2, W_3, W_4, \ldots, W_{N-1}$ and $W_N$ are assigned to the subframes SF in this order. These weights $W_1, W_2, W_3, W_4, \ldots, W_{N-1}$ and $W_N$ define the number of times of display discharge in each subframe SF. Although the subframes are arranged in the order of the weight in FIG. 2, other orders may be adopted. In adaptation to this frame structure, the frame period Tf that is a frame transmission period is divided into N subframe periods Tsf, so that one subframe period Tsf is assigned to each of the subframes SF. In addition, the subframe period Tsf is divided into a reset period TR for initializing wall charge, an address period TA for addressing and a display period TS for sustaining. Lengths of the reset period TR and the address period TA are constant regardless of weight, while the length of the display period TS is longer as the weight is larger. Therefore, the length of the subframe period Tsf is also longer as the weight of the corresponding subframe SF is larger. The order of the reset period TR, the address period TA and the display period TS is constant in N subframes SF. The initialization, the addressing and the sustaining of the wall charge are performed for each subframe.

Figure 3:
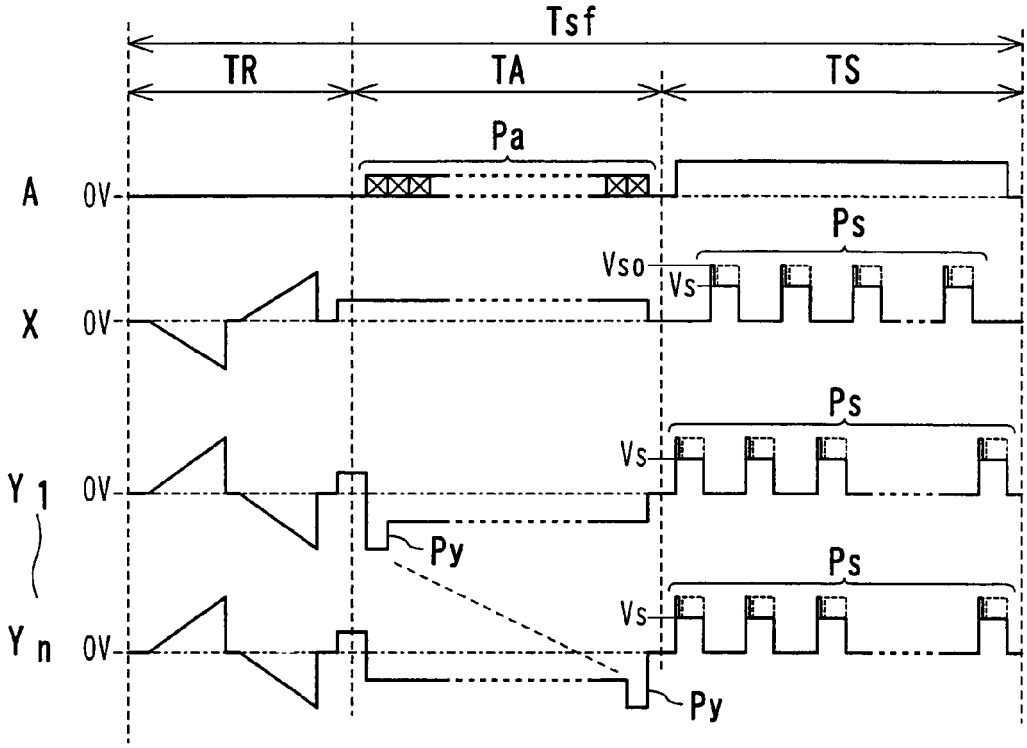
FIG. 3 is a schematic diagram of drive voltage waveforms.

FIG. 3 is a schematic diagram of drive voltage waveforms. In FIG. 3, suffixes (1, n) of the display electrode Y indicate an arrangement order of the corresponding row. The waveforms shown in FIG. 3 are an example, and the amplitude, the polarity and the timing can be modified variously.

During the reset period TR of each subframe, in order to add an increasing voltage between the display electrodes of all cells, ramp waveform pulses of negative and positive polarities are applied alternately to all display electrodes X while ramp waveform pulses of positive and negative polarities are applied alternately to all display electrodes Y. The amplitudes of these ramp waveform pulses increase at a rate small enough for generating micro discharge. A total voltage that is the sum of the amplitudes of the pulses applied to the display electrodes X and Y is applied to the cell. The micro discharge generated by the first application of the increasing voltage generates an appropriate wall voltage of the same polarity in all cells regardless that the cell was lighted or not in the previous subframe. The micro discharge generated by the second application of the increasing voltage adjusts the wall voltage to a value that corresponds to the difference between the discharge start voltage and the amplitude of the applied voltage.

In the address period TA, the wall charge that is necessary for the sustaining process is formed only in cells to be lighted. While all display electrodes X and all display electrodes Y are biased to a predetermined potential, a scan pulse Py is applied to one display electrode Y that corresponds to the selected row every row selection period (i.e., a period for scanning one row). An address pulse Pa is applied only to the address electrode A that corresponds to the selected cell in which the address discharge is to be generated at the same time as the above-mentioned row selection. Namely, the potential of the address electrode A is controlled in a binary manner in accordance with the subframe data Dsf of the selected row. Discharge is generated between the display electrode Y and the address electrode A in the selected cell, and the discharge triggers surface discharge between the display electrodes. This series of discharge is the address discharge.

During the display period TS, a display pulse Ps that corresponds to a so-called sustain pulse is applied alternately to the display electrode Y and the display electrode X. In this way, a pulse train having alternating polarities is applied between the display electrodes. The application of the display pulse Ps causes surface discharge in the cell in which a predetermined wall charge is remained. The number of application times of the display pulse Ps corresponds to the weight of the subframe as explained above.

Concerning the above-explained driving sequence, the application of the display pulse Ps in the display period TS is most relevant to the present invention. In addition, it is important that the waveform of the display pulse Ps is not fixed and that one of the plural types of waveforms is selected for each subframe in accordance with the display ratio.

Figure 4:
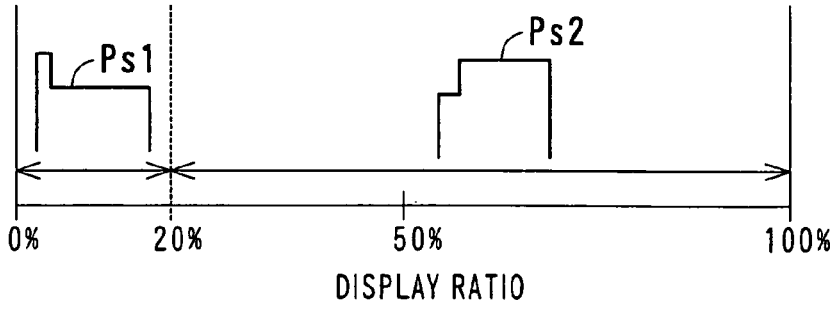
FIG. 4 is a diagram showing an example of a relationship between a display ratio and a display pulse waveform.

FIG. 4 shows an example of a relationship between a display ratio and a display pulse waveform. In this illustrated example, the set value for the classification is 20%. The range of the display ratio $\alpha$ is divided into two ranges, i.e., the range that satisfies $0\% \leqq \alpha < 20\%$ and the range that satisfies $20\% \leqq \alpha \leqq 100\%$. The waveforms of the display pulses Ps1 and Ps2 are determined for each range. The display pulse Ps1 that is used for the subframe having a display ratio $\alpha$ that satisfies $0\% \leqq \alpha < 20\%$ has a first step-like waveform in which the amplitude decreases between a leading edge and a trailing edge. The display pulse Ps2 that is used for the subframe having a display ratio $\alpha$ that satisfies $20\% \leqq \alpha \leqq 100\%$ has a second step-like waveform in which the amplitude increases between a leading edge and a trailing edge.

The luminance of discharge at one time corresponding to the application of the pulse is different between the display pulse Ps1 and the display pulse Ps2. By adjusting the number of times of pulse application so as to compensate the difference of the luminance, a gradation display can be realized in the same way as the case where the same waveform is applied to plural subframes.

Figure 5:
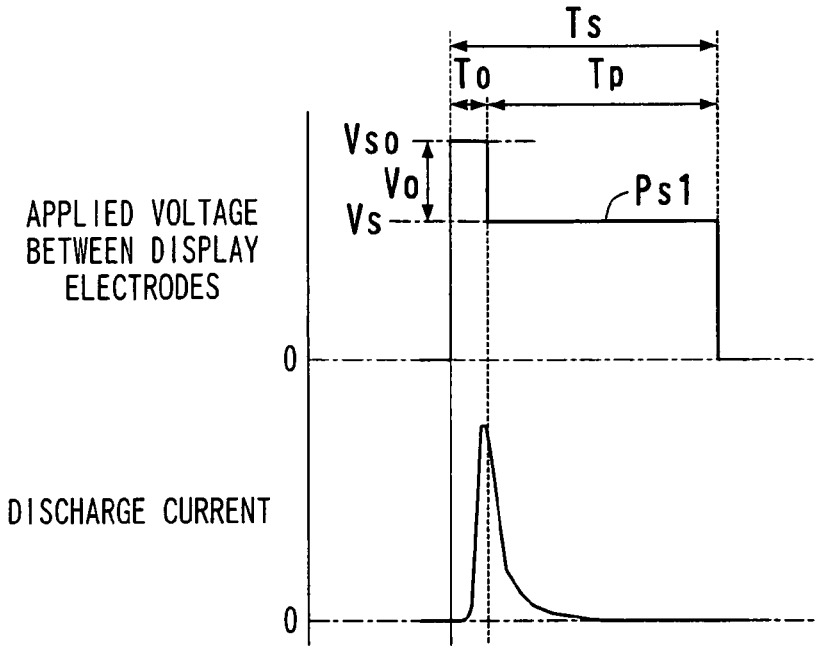
FIG. 5 is an explanatory diagram showing a change of amplitude in a first step-like waveform.

FIG. 5 is an explanatory diagram showing a change of amplitude in the first step-like waveform. The waveform of the display pulse Ps1 has basically a two-step shape in which the pulse period Ts is divided into a period To having large amplitude and a period Tp having small amplitude. More specifically, there is a transition period for switching the amplitude, and the period To is divided into a period for applying a sustaining voltage Vso of a high level and a period for lowering the applied voltage. The high level sustaining voltage Vso corresponds to a voltage that is a sustaining voltage Vs plus an offset voltage Vo having the same polarity as the sustaining voltage Vs. In the period To, capacitance between the display electrodes is charged so that the applied voltage between the electrodes increases. After that, the display discharge starts, and discharge current starts to flow from the power source to the display electrode pair. The period To is set so that the application of the high level sustaining voltage Vso is finished before the discharge ends.

The first step-like waveform shown in FIG. 5 has an advantage that stronger display discharge can be generated for increasing the luminance than the rectangular waveform of the amplitude Vs, since the offset voltage Vo is added. On the contrary, there is a disadvantage that larger electric power is consumed for charging and discharging the capacitance between the electrodes, since the offset voltage Vo is added. However, if the charging current in the capacitance becomes a part of the discharging current in the display discharge, power loss will be reduced compared with the case where the entire discharge current is supplied from the power source. The first step-like waveform that is optimized so that the increase of the luminance overcomes the increase of the power consumption can improve the light emission efficiency. The first step-like waveform is suitable for the case where the voltage drop in the output from the power source is small. In other words, it is suitable for a display of a subframe that has a relatively small display ratio.

Figure 6:
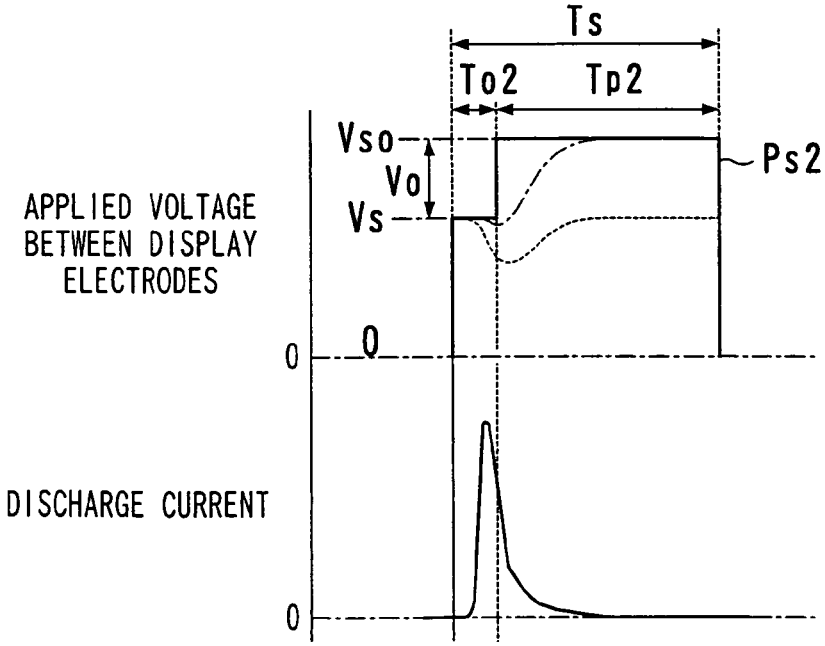
FIG. 6 is an explanatory diagram showing a change of amplitude in a second step-like waveform.

FIG. 6 is an explanatory diagram showing a change of amplitude in a second step-like waveform. The waveform of the display pulse Ps2 has basically a two-step shape in which the pulse period Ts is divided into a period To2 having a small amplitude and a period Tp2 having a large amplitude. More specifically, there is a transition period for switching the amplitude, and the period To2 is divided into a period for applying a sustaining voltage Vs and a period for raising the applied voltage. The high level sustaining voltage Vso corresponds to a voltage that is a sustaining voltage Vs plus an offset voltage Vo having the same polarity as the sustaining voltage Vs. In the period To2 the display discharge starts. The period To2 is set so that the application of the high level sustaining voltage Vso starts before the discharge ends.

The second step-like waveform shown in FIG. 6 has an advantage that higher voltage can be applied to a cell than the rectangular waveform of the amplitude Vs, since the offset voltage Vo is added, so that an adequate quantity of wall charge can be reformed. In the case of the rectangular waveform, the amplitude is decreased temporarily by the voltage drop due to the discharge as shown by a dotted line in FIG. 6. In the case of the second step-like waveform, although the increase of the amplitude becomes gentle due to the voltage drop as shown by a long-dashed-short-dashed line in FIG. 6, the amplitude hardly drops during the discharge. The second step-like waveform is suitable for the case where the voltage drop in the output from the power source is large. In other words, it is suitable for a display of a subframe that has a relatively large display ratio.

The amplitude (the sustaining voltage Vs and the high level sustaining voltage Vso) can be determined for the first step-like waveform and the second step-like waveform separately. However, one or both of the sustaining voltage Vs and the high level sustaining voltage Vso may use the two waveforms commonly for the determination, so that the circuit can be simplified by sharing the power source. For example, a set of the power source line of the potential Vs and the power source line of the potential Vso, or a set of the power source line of the potential Vs and the power source line of the potential Vo is provided, and a switching circuit is used for connecting or disconnecting between these power source lines and the display electrode. Then, an operational timing of the switching circuit is switched, so that the first and the second step-like waveforms can be generated.

FIGS. 7A-7D are diagrams showing variations of a relationship between a display ratio and a display pulse waveform.

Figure 7A:
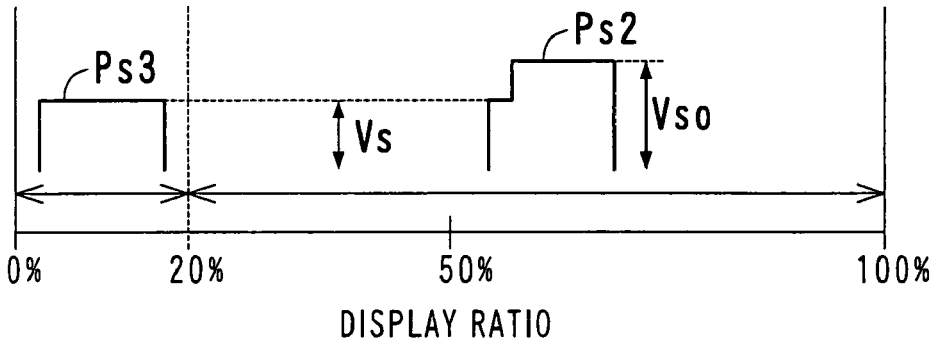
FIGS. 7A-7D are diagrams showing variations of a relationship between a display ratio and a display pulse waveform.

In the example shown in FIG. 7A, a display pulse Ps3 having a rectangular waveform of the amplitude Vs is used for the subframe having the display ratio $\alpha$ that satisfies $0\% \leqq \alpha < 20\%$, while the display pulse Ps2 having a second step-like waveform is used for the subframe having the display ratio $\alpha$ that satisfies $20\% \leqq \alpha \leqq 100\%$.

When the display ratio is small, the voltage drop is little. Therefore, an adequate quantity of wall charge can be reformed even if the amplitude is made smaller than the case where the display ratio is large. Decreasing the amplitude contributes to reducing power consumption. Although use of the first step-like waveform has an advantage for improving the light emission efficiency, the effect of using the first step-like waveform is little especially in the case where a variation of characteristics among cells is large. Therefore, a rectangular waveform is suitable since a pulse output control is easy for the rectangular waveform.

Figure 7B:
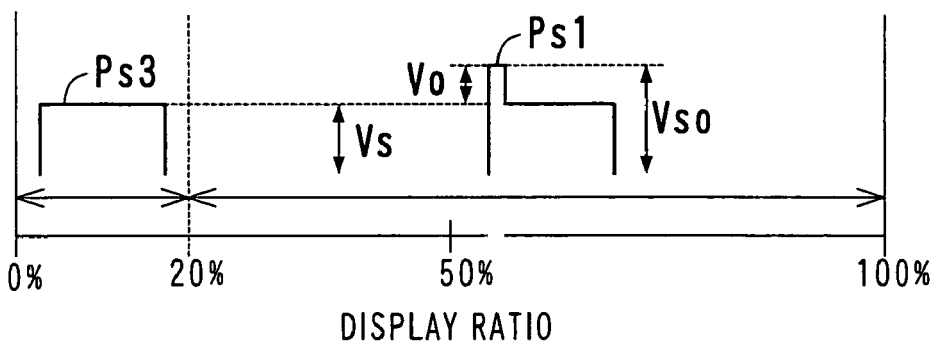

In the example shown in FIG. 7B, the display pulse Ps3 having a rectangular waveform of the amplitude Vs is used for the subframe having the display ratio $\alpha$ that satisfies $0\% \leqq \alpha < 20\%$, while the display pulse Ps1 having the first step-like waveform is used for the subframe having the display ratio $\alpha$ that satisfies $20\% \leqq \alpha \leqq 100\%$.

When the display ratio $\alpha$ is small, power consumption due to discharge is little, and major part of total power consumption is power consumption due to charge and discharge of the capacitance between electrodes. If the first step-like waveform is always used in a panel having large capacitance between electrodes, the light emission efficiency may be deteriorated on the contrary. It is because that if the display ratio $\alpha$ is smaller, it may happen more easily that a part of electric charge that charges the capacitance between electrodes in the entire panel by the offset voltage Vo is not used efficiently for discharge. In this case, it is preferable to use the display pulse Ps1 only when it is estimated that the energy that was stored in the capacitance between electrodes is utilized efficiently in the discharge, i.e., when the display ratio $\alpha$ satisfies $20\% \leqq \alpha \leqq 100\%$.

Figure 7C:
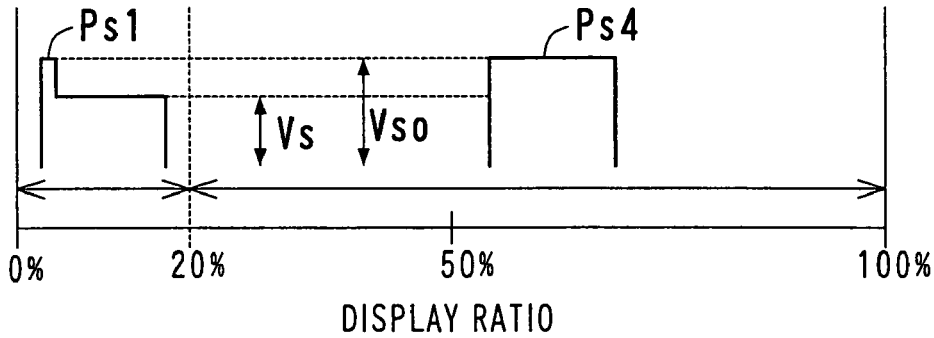

In the example shown in FIG. 7C, the display pulse Ps4 having a rectangular waveform of the amplitude Vso is used for the subframe having the display ratio $\alpha$ that satisfies $20\% \leqq \alpha \leqq 100\%$, while the display pulse Ps1 having the first step-like waveform is used for the subframe having the display ratio $\alpha$ that satisfies $0\% \leqq \alpha < 20\%$. The use of the rectangular waveform has an advantage that the pulse output control becomes easy.

Figure 7D:
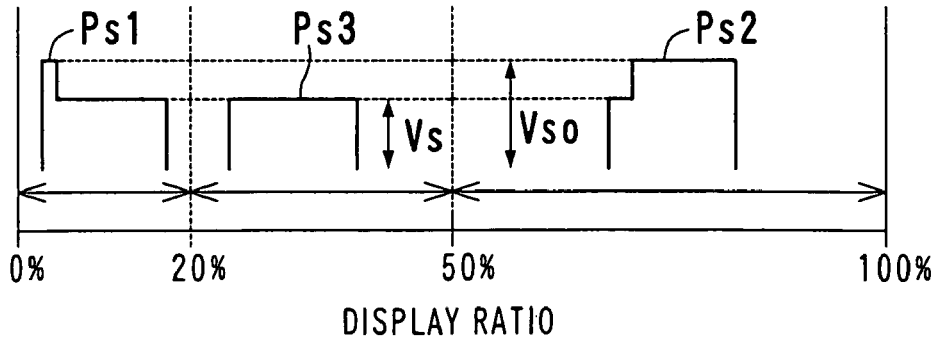

In the example shown in FIG. 7D, using a first set value 20% and a second set value 50% for the classification, the display ratio is classified into three ranges, i.e., the range that satisfies $0\% \leqq \alpha < 20\%$, the range that satisfies $20\% \leqq \alpha < 50\%$ and the range that satisfies $50\% \leqq \alpha \leqq 100\%$. The display pulse Ps1 having the first step-like waveform is used for the subframe having the display ratio $\alpha$ that satisfies $0\% \leqq \alpha < 20\%$, the display pulse Ps3 having the rectangular waveform of the amplitude Vs is used for the subframe having the display ratio $\alpha$ that satisfies $20\% \leqq \alpha < 50\%$ and the display pulse Ps2 having the second step-like waveform is used for the subframe having the display ratio $\alpha$ that satisfies $50\% \leqq \alpha \leqq 100\%$.

When classifying the display ratio in detail so as to use more types of waveforms, a probability of applying excessive voltage is reduced, resulting in higher effect of suppressing wasteful power consumption.

In the above-mentioned embodiments, the set values for classifying the display ratio are not limited to the exemplified values. They should be changed if necessary in accordance with discharge characteristics of the plasma display panel to be driven.

Second Embodiment

A display device according to a second embodiment has the same structure as shown in FIG. 1 except for the difference of function of the controller 71. The structure of the frame in the second embodiment is also the same as the structure shown in FIG. 2. In addition, the initialization, the addressing and the sustaining of the wall charge are performed for each subframe in the second embodiment, too. Here, a detailed explanation about items that are the same as the first embodiment will be omitted.

The second embodiment is characterized in that the relationship between the display ratio and the display pulse waveform is not determined uniquely. In the above first embodiment, the display pulse waveform is determined independently for each subframe in accordance with the display ratio, so one waveform is determined when the display ratio is fixed regardless of a value of the display ratio. In the second embodiment, plural types of display pulse waveforms are related to a display ratio within a predetermined range (the entire or a part of the range), and a waveform is selected to be used for each subframe in accordance with the relationship of the display ratio in plural subframes that constitute the frame. An automatic power control (APC) is related to the selection of the display pulse waveform.

The automatic power control is a function of realizing a display that is bright and good in visibility as much as possible while the power consumption in the sustaining process does not exceed the permissible limit by utilizing the fact that even if the light emission quantity of each cell is little, it is not so conspicuous in a display having a bright screen as a whole. By the automatic power control, the number of display pulses that are applied in a display of each subframe is increased or decreased in accordance with a total sum of the display ratios of subframes included in one frame, so that a ratio of luminance values between the subframes is kept to equal to a ratio of weight values. The automatic power control is important for reducing power consumption and as a measure against heat.

Figure 8A:
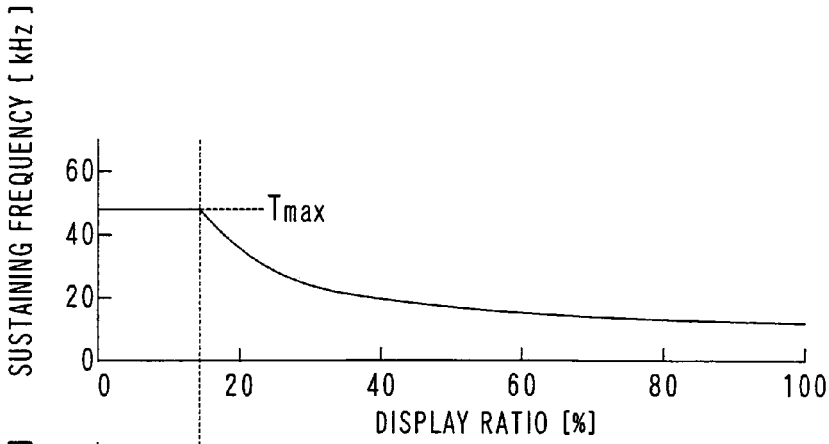
FIGS. 8A and 8B are diagrams showing a general concept of an automatic power control.
Figure 8B:
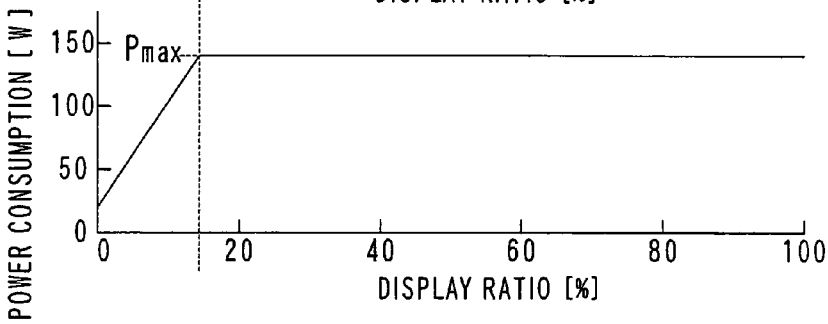

FIGS. 8A and 8B show a general concept of an automatic power control. When the display ratio is smaller than a constant value (approximately 15% in this example), the automatic power control is not performed substantially, and the number of display pulses is the maximum number that can be applied during a period that is determined by the frame period. In this case, the length of the period necessary as the display period is the upper limit value Tmax. In FIG. 8A, the number of display pulses is shown as a sustaining frequency. When the display ratio is smaller than the above-mentioned constant value, the power consumption increases as the display ratio increases. When the display ratio is the above-mentioned constant value, the power consumption is the upper limit value Pmax of the permissible range. When the display ratio exceeds the above-mentioned constant value, the automatic power control function works, and the number of display pulses (the sustaining frequency) decreases as the display ratio increases.

Figure 9:
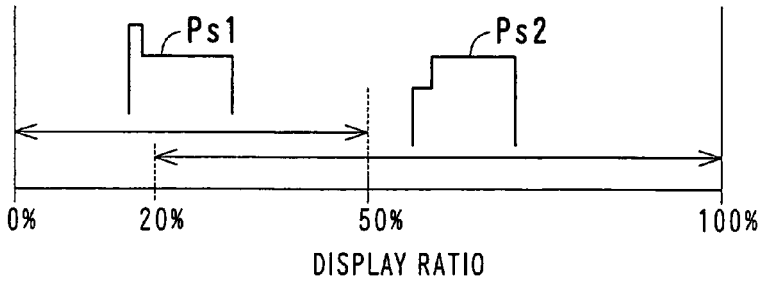
FIG. 9 is a diagram showing an example of a relationship between a display ratio and a display pulse waveform in a second embodiment.

FIG. 9 shows an example of a relationship between a display ratio and a display pulse waveform in a second embodiment. In the illustrated example, the display ratio is classified into three ranges, i.e., the range that satisfies $0\% \leqq \alpha < 20\%$, the range that satisfies $20\% \leqq \alpha < 50\%$ and the range that satisfies $50\% \leqq \alpha \leqq 100\%$. Concerning the ranges that satisfies $0\% \leqq \alpha < 20\%$ and the range that satisfies $50\% \leqq \alpha \leqq 100\%$, the corresponding waveform is fixed. Namely, the display pulse Ps1 having the first step-like waveform is used for the subframe having the display ratio $\alpha$ that satisfies $0\% \leqq \alpha < 20\%$, while the display pulse Ps2 having the second step-like waveform is used for the subframe having the display ratio $\alpha$ that satisfies $50\% \leqq \alpha < 100\%$. The two waveforms correspond to the remained range that satisfies $20\% \leqq \alpha < 50\%$. Namely, the display pulse Ps1 or the display pulse Ps2 is used for the subframe having the display ratio that satisfies $20\% \leqq \alpha < 50\%$. It is decided which of the display pulses Ps1 and Ps2 is used in accordance with the result of an operation that will be explained below.

For the explanation of the operation, luminance weight of the i-th (i=1–N) subframe in the display order among N subframes that constitute the frame is denoted by $w_i$. The expression $\{w_i\}$ denotes a set of weights that are normalized so as to satisfy the following equation.

$$\sum_{i=1}^{N} w_i = 1 \tag{1}$$

The luminance of the i-th subframe is denoted by $w_i$ L when L denotes the luminance of the highest gradation in the gradation range.

When the frame data are converted into the subframe data, a set of N display ratios is determined. This is denoted by $\{\alpha_i\}$. Here, $\alpha_i$ is a value within a range between 0 and 1 that is proportional to the number of cells to be lighted. $\alpha_i$ is 0 for the entire extinction, while $\alpha_i$ is 1 for the entire lighting.

The luminance of one time of display discharge depends on the display ratio and the discharge form at that time. The discharge form is denoted by a variable $\beta_i$, and the luminance of the i-th subframe per discharge is expressed by $s(\alpha_i, \beta_i)$. A value that corresponds to either the discharge generated by the display pulse Ps1 having the first step-like waveform or the discharge generated by the display pulse Ps2 having the second step-like waveform is assigned to $\beta_i$.

When the number of display pulses in the i-th subframe is denoted by $f_i$, the following equation is satisfied.

$$f_i s(\alpha_i, \beta_i) = w_i L \tag{2}$$

Here, the sum of lengths of N display periods corresponding to the frame is denoted by T. T has the upper limit value Tmax. Therefore, when an interval between the display discharge in the i-th subframe is denoted by $t_i$, the following equation must be satisfied.

$$T = \sum_{i=1}^{N} f_i t_i \leq T_{max} \tag{3}$$

Furthermore, the electric power (including a reactive power) concerning one time of display discharge also depends on the display ratio and the discharge form at that time. Here, using the display ratio $\alpha_i$ and the discharge form $\beta_i$, the electric power per discharge in the i-th subframe is expressed by $p(\alpha_i, \beta_i)$. Since the electric power P that is consumed by the display of the frame also has the upper limit value Pmax, the following equation must be satisfied.

$$P = \sum_{i=1}^{N} f_i p(\alpha_i, \beta_i) \leq P_{max} \tag{4}$$

The above argument will be summed up as follows. It is supposed that the functions $s(\alpha_i, \beta_i)$ and $p(\alpha_i, \beta_i)$ are known as characteristics of the panel. The purpose is to determine a set of $\{f_i, \beta_i\}$ that matches the ratio $\{w_i\}$ of a predetermined luminance when a selected set of $\{\alpha_i\}$ is given by entering the frame data. In this determination, a set of $\{f_i, \beta_i\}$ is selected that satisfies the limitation of the equations (3) and (4) and makes the luminance L of the maximum gradation maximum.

An example will be explained. First, a selected combination $\{\beta_i\}$ is considered for a given $\{\alpha_i\}$. Thus, $\{s(\alpha_i, \beta_i), p(\alpha_i, \beta_i)\}$ is determined.

When P=Pmax, the luminance value L is determined in accordance with the equations (2) and (4) and the following equation.

$$L = P_{max} \Big/ \sum_{i=1}^{N} \frac{w_i p(\alpha_i, \beta_i)}{s(\alpha_i, \beta_i)} \tag{5}$$

Using this luminance value L, $f_i$ is derived as follows.

$$f_i = L \frac{w_i}{s(\alpha_i, \beta_i)} \tag{6}$$

Thus, T is determined by the following equation.

$$T = L \sum_{i=1}^{N} \frac{w_i t_i}{s(\alpha_i, \beta_i)} \tag{7}$$

It is sufficient that T is Tmax or less. If T>Tmax, the number of display pulses of the frame is reduced until T=Tmax so that the ratio of the luminance is maintained. When the reduced number of pulses is denoted by $f_i'$, the luminance is denoted by L', and the electric power is denoted by P', the following equation is satisfied.

$$L' = L - (T - T_{max}) \Big/ \sum_{i=1}^{N} \frac{w_i t_i}{s(\alpha_i, \beta_i)} \tag{8}$$

$$f_i' = f_i - (T - T_{max}) \frac{w_i}{s(\alpha_i, \beta_i)} \Big/ \sum_{j=1}^{N} \frac{w_j t_j}{s(\alpha_j, \beta_j)} \tag{9}$$

$$P' = P_{max} - (T - T_{max}) \sum_{i=1}^{N} \frac{w_i p(\alpha_i, \beta_i)}{s(\alpha_i, \beta_i)} \Big/ \sum_{j=1}^{N} \frac{w_j t_j}{s(\alpha_j, \beta_j)} \tag{10}$$

As explained above, $\{f_i\}$ that satisfies the condition defined by the equations (3) and (4) is obtained for a selected $\{\beta_i\}$. In this way, the above-explained calculation is performed in parallel for all selectable $\{\beta_i\}$, and the results are compared with each other so that one having the largest luminance L is selected and adopted.

Figure 10:
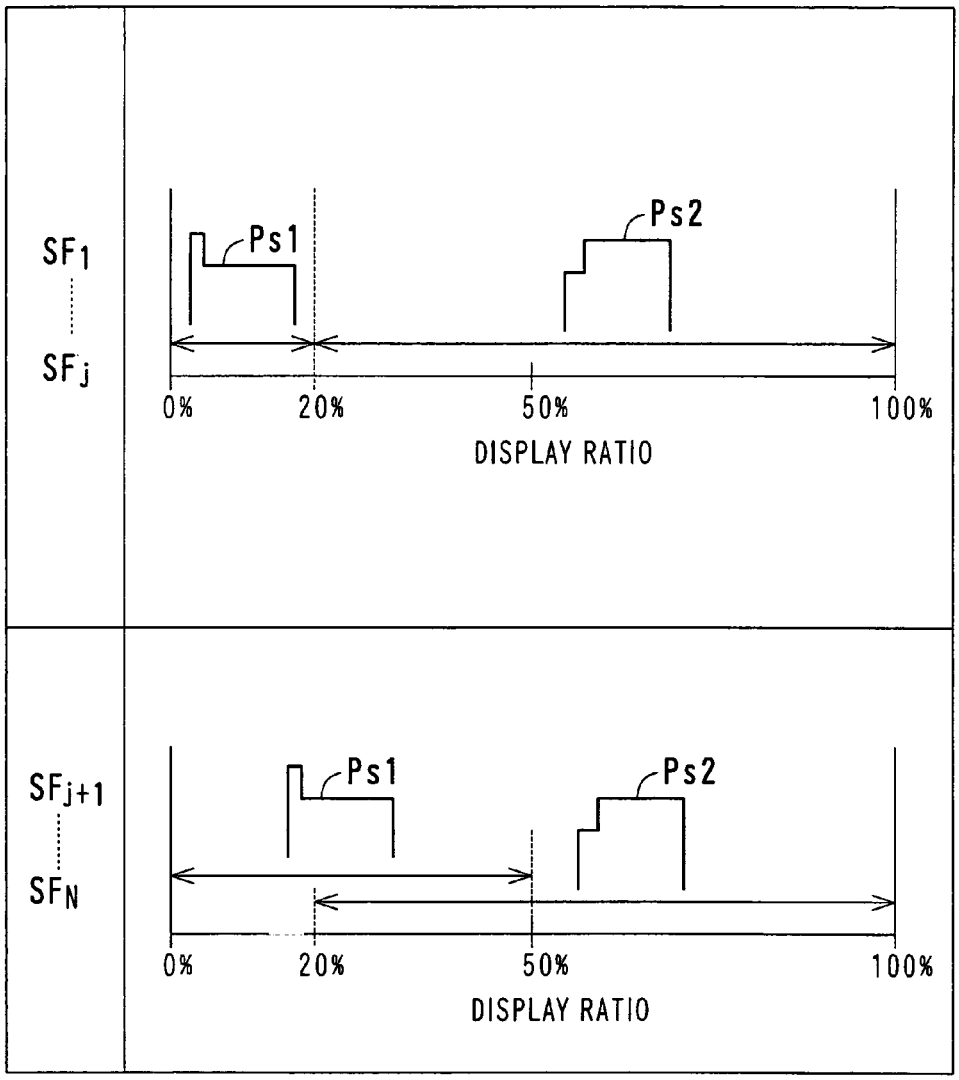
FIG. 10 is a diagram showing an example of a relationship among a subframe, a display ratio and a display pulse waveform.

However, the number of combinations for assigning two types of display pulse waveforms to N subframes is $2^N$ at most, so a processor for the calculation is overloaded. Concerning this problem, there is a countermeasure of reducing subframes in which the waveform is selected. For example, when a certain $\{\alpha_i\}$ is given, the subframes having $\alpha_i$=0 are excluded from objects in which the selection of the waveform is considered. Alternatively, N subframes are divided into two groups by noting the weights as shown in FIG. 10, and one of the groups is excluded from objects in which the selection of the waveform is considered. Namely, the selection of the waveform is performed only for a few subframes that have relatively large weights and are considered to have large effect of the waveform selection. In the example shown in FIG. 10, the subframes $SF_1, \ldots, SF_j$ are excluded from objects in which the selection of the waveform is considered, and subframes $SF_{j+1}, \ldots, SF_N$ are objects in which the selection of the waveform is considered.

In the above-explained second embodiment, it is possible to assign plural types of waveforms to the entire range (0-100%) of the display ratio. The set value for classifying the display ratio can be modified if necessary in accordance with discharge characteristics of the plasma display panel to be driven.

The present invention is useful for improving luminosity and reducing power consumption in a display device that includes a plasma display panel.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel including a plurality of cells, the method comprising:

detecting a display ratio in accordance with a number of cells to be lighted for at least one subframe;

applying a sustain pulse train during a display period of at least one subframe having a display ratio exceeding twenty percent, the sustain pulse train including a first waveform in which amplitude of a leading edge is smaller than amplitude of a trailing edge; and applying a sustain pulse train, including a second waveform different from the first waveform, during a display period of at least one subframe having a display ratio equal to or less than twenty percent.

2. The method according to claim 1, wherein the sustain pulse train including the first waveform is applied for at least one subframe having a display ratio exceeding fifty percent, and a sustain pulse train including a third waveform different from the first waveform and the second waveform is applied for at least one subframe having a display ratio with a range of twenty percent to fifty percent.

3. The method according to claim 1, wherein the second waveform is a waveform in which amplitude of a leading edge is larger than amplitude of a trailing edge or a rectangular waveform.

4. A method for driving a plasma display panel displaying an image of one frame with a plurality of subframes, to each of which a luminance weight is assigned, the method comprising;

detecting a display ratio in accordance with a number of cells to be lighted for at least one subframe; and applying a sustain pulse for at least one subframe having a display ratio with a range of twenty percent to fifty percent, the sustain pulse including one waveform selected from among sustain pulse waveforms that differ from each other in luminance in one discharge by one pulse and power characteristics in one discharge by one pulse, wherein a waveform and the number of a sustain pulse assigned to the at least one subframe is selected based on a result of a calculation, in view of a luminance weight to be assigned to the at least one subframe, said calculation being performed including a luminance of a sustain pulse waveform to be assigned to the remaining subframes, and power characteristics of the sustain pulse, so that power consumption for the one frame is limited to a predetermined upper limit value in accordance with a display ratio per frame and so that luminance of a cell with the highest gradation in one frame is highest.

5. A display device using a plasma display panel including a plurality of display electrode pairs, a plurality of address electrodes crossing the display electrode pairs, and a plurality of cells each of which is defined at an intersection of the display electrode pair and the address electrode, the display device comprising:

a display ratio detection portion that detects a display ratio in accordance with a number of cells to be lighted for at least one subframe;

a controller that determines a waveform of a sustain pulse to be applied to the display electrode pair during a display period of the at least one subframe in accordance with a display ratio detection signal obtained from the display ratio detection portion; and an X-driver and a Y-driver that apply a sustain pulse to the display electrode pair alternately, wherein the controller outputs a first control signal for selecting a first waveform in which amplitude of a leading edge is smaller than amplitude of a trailing edge for at least one subframe having a display ratio exceeding twenty percent, the controller outputs a second control signal for selecting a second waveform that is different from said first waveform for at least one subframe having a display ratio equal to or less than fifty percent, and a sustain pulse having the first waveform or the second waveform selected in accordance with the control signal outputted from the controller is applied to the display electrode pair by the X-driver and the Y-driver.

6. The display device according to claim 5, wherein the controller includes a memory portion that stores a relationship between a predetermined display ratio and sustain pulse waveforms, and a sustain pulse waveform is determined with reference to the memory portion.

7. The display device according to claim 5, wherein the controller includes an processor configured to perform a calculation, and the processor calculates a waveform of a sustain pulse and the number of the sustain pulse to be applied for a subframe having a display ratio with a range of twenty percent to fifty percent in accordance with a luminance of each of the waveforms and the power characteristics so that power consumption per frame does not exceed a predetermined upper limit of the power consumption value.

* * * * *

UNITED STATES PATENT AND TRADEMARK OFFICE

CERTIFICATE OF CORRECTION

PATENT NO. : 7,995,007 B2
APPLICATION NO. : 12/081028
DATED : August 9, 2011
INVENTOR(S) : Naoki Itokawa et al.

It is certified that error appears in the above-identified patent and that said Letters Patent is hereby corrected as shown below:

Title Pg, Item (73) Under "Assignees", Delete "Hatachi Plasma Patent Licensing Co., Ltd., Tokyo (JP)" and insert --Hitachi Plasma Patent Licensing Co., Ltd., Tokyo (JP)--.

Signed and Sealed this
Twenty-fifth Day of October, 2011

David J. Kappos

David J. Kappos
*Director of the United States Patent and Trademark Office*